US009087683B2

(12) United States Patent
Girault et al.

(10) Patent No.: US 9,087,683 B2
(45) Date of Patent: Jul. 21, 2015

(54) ELECTROSTATIC SPRAY IONIZATION METHOD

(71) Applicant: Ecole Polytechnique Federale de Lausanne, Lausanne (CH)

(72) Inventors: Hubert Hugues Girault, Ropraz (CH); Baohong Liu, Shanghai (CN); Yu Lu, Ecublens (CH); Liang Qiao, Prilly (CH); Romain Sartor, Chavannes-de-Bogis (CH); Elena Tobolkina, Lausanne (CH)

(73) Assignee: Ecole Polytechnique Federale de Lausanne, Lausanne (CH)

( * ) Notice: Subject to any disclaimer, the term of this patent is extended or adjusted under 35 U.S.C. 154(b) by 0 days.

(21) Appl. No.: 14/370,586

(22) PCT Filed: Jan. 4, 2013

(86) PCT No.: PCT/EP2013/050122

§ 371 (c)(1),
(2) Date: Jul. 3, 2014

(87) PCT Pub. No.: WO2013/102670

PCT Pub. Date: Jul. 11, 2013

(65) Prior Publication Data

US 2015/0001389 A1 Jan. 1, 2015

Related U.S. Application Data

(60) Provisional application No. 61/583,932, filed on Jan. 6, 2012.

(51) Int. Cl.

| | |
|---|---|
| ***H01J 49/26*** | (2006.01) |
| ***H01J 49/16*** | (2006.01) |
| ***H01J 49/00*** | (2006.01) |
| ***H01J 49/04*** | (2006.01) |

(52) U.S. Cl.
CPC ..... *H01J 49/165* (2013.01); *H01J 49/0031* (2013.01); *H01J 49/0431* (2013.01)

(58) Field of Classification Search
USPC ..... 250/281, 282, 288
See application file for complete search history.

(56) References Cited

U.S. PATENT DOCUMENTS

| | | | | |
|---|---|---|---|---|
| 5,595,636 | A | | 1/1997 | Franzen |
| 5,808,300 | A | | 9/1998 | Caprioli |
| 6,110,343 | A | | 8/2000 | Ramsey et al. |
| 6,127,082 | A | * | 10/2000 | Humberstone et al. .... 430/118.3 |
| 7,037,417 | B2 | | 5/2006 | Rossier et al. |
| 7,098,450 | B2 | | 8/2006 | Rossier et al. |
| 7,615,354 | B2 | | 11/2009 | Faupel et al. |
| 8,080,784 | B2 | | 12/2011 | Liang et al. |

(Continued)

OTHER PUBLICATIONS

Jiangjiang Liu et al., "Development, Characterization, and Application of Paper Spray Ionization", Analytical Chemistry, vol. 82, No. 6, pp. 2463-2471, Mar. 15, 2010.

Guangming Huang et al., "Induced Nanoelectrospray Ionization for Matrix-Tolerant and High-Throughput Mass Spectrometry", Angewandte Chemie International Edition, vol. 50, No. 42, pp. 9907-9910, Sep. 5, 2011.

(Continued)

*Primary Examiner* — Nicole Ippolito
(74) *Attorney, Agent, or Firm* — Howson & Howson LLP

(57) ABSTRACT

In an electrostatic spray ionization method for spraying a liquid layer from an insulating plate 2, the plate is arranged between two electrodes 1, 4. A constant high voltage power supply 3 is provided and an electric circuit is used to charge and discharge locally a surface of the liquid layer 7 on the insulating plate 2 by applying the power supply between the electrodes 1, 4.

16 Claims, 21 Drawing Sheets

(56) References Cited

U.S. PATENT DOCUMENTS

| | | | | |
|---|---|---|---|---|
| 2005/0056776 | A1* | 3/2005 | Willoughby et al. | 250/281 |
| 2005/0230635 | A1* | 10/2005 | Takats et al. | 250/424 |
| 2006/0113463 | A1 | 6/2006 | Rossier et al. | |
| 2009/0197295 | A1 | 8/2009 | Fournier et al. | |
| 2010/0248388 | A1 | 9/2010 | Liu et al. | |
| 2011/0240844 | A1* | 10/2011 | Ouyang et al. | 250/282 |
| 2012/0119079 | A1 | 5/2012 | Ouyang et al. | |

OTHER PUBLICATIONS

Liang Qiao et al., "Electrostatic-Spray Ionization Mass Spectrometry", Analytical Chemistry, vol. 84, No. 17, pp. 7422-7430, Aug. 9, 2012.

Liang Qiao et al., "Supporting Information: Electrostatic-Spray Ionization Mass Spectrometry", Analytical Chemistry, Aug. 9, 2012.

M. Yamashita et al., "Electrospray Ion SOurce. Another Variation on the Free-Jet Theme", Journal of Physical Chemistry, vol. 88, pp. 4451-4459, 1984 (month unknown).

* cited by examiner

Bring electrode of top of microcone and do nESI by capacitive coupling

Dielectric coated electrode

Array of microcone to be spotted
By the sample

ELECTROSTATIC SPRAY IONIZATION METHOD

BACKGROUND TO THE INVENTION

The present invention relates to an electrostatic spray ionization method.

Electrospray is a phenomenon that has been studied as early as 1749 when Nollet described the spray from a metallic orifice that was electrified electrostatically (Nollet J A. 1749. Recherches sur les causes particulières des phénomènes électriques. *Recherches sur les causes particulières des phénomènes électriques,* 1ère edn. Chez les frères Guerin, Paris). Since the 1980's, electrospray ionization (ESI) has been widely used as a powerful technique to softly ionize large compounds from solution for Mass Spectrometry (MS) analyses [Yamashita M, Fenn J B. 1984. Electrospray ion-source—another variation on the free-jet theme. *Journal Of Physical Chemistry* 88: 4451-59].

The principle of electrospray ionization is based first on the ejection of charged microdroplets from the tip of a capillary or microchannel and then on the formation of gas phase ions from the microdroplets. When a high potential difference is applied between an electrode placed in contact with the solution to be sprayed and a counter electrode, such as a mass spectrometer, placed in the vicinity of the tip, a fine mist of charged microdroplets is emitted from the tip of the capillary or microchannel and flies to the counter electrode. The microdroplets reduce in size during the flight by solvent evaporation and/ or by coulomb explosion to form gas phase ions representative of the species in solution.

Two mechanisms have been proposed for the formation of gas-phase ions from charged microdroplets. The first one is called Charged Residue Model (CRM). According to this model, there is a formation of extremely small microdroplets with a radius approximately equal to 1 nm and containing only one analyte ion. Solvent evaporation from such microdroplet leads to the formation of a gas-phase ion. The second mechanism considers Ion Evaporation (IE) from small and highly charged microdroplets. The model predicts that ion emission from the microdroplets becomes possible when the radius of the microdroplet is sufficiently small ($r<10$ nm) [Dole M, Mack L L, Hines R L, Chemistry D O, Mobley R C, et al. 1968. Molecular beams of macroions. *The Journal of Chemical Physics* 49: 2240-49; Mack L L, Kralik P, Rheude A, Dole M. 1970. Molecular beams of macroions. II. *The Journal of Chemical Physics* 52: 4977-86; Iribarne J V, Thomson B A. 1976. On the evaporation of small ions from charged droplets. *The Journal of Chemical Physics* 64: 2287-94].

In classical ESI-MS, a high potential is applied on an electrode in contact with the solution in a microchannel or a capillary. The mass spectrometer acts as the counter electrode. When a current flows through the electrospray emitter, electrochemical reactions occur both at the electrode/solution interface and at the ion detector. In positive ionization mode, the electrode acts as an anode where oxidation reactions take place. Conversely in negative ion mode, the electrode acts as a cathode where reduction reactions take place. These electrode reactions take place to ensure the electroneutrality of the solution [Abonnenc M, Qiao L A, Liu B H, Girault H H. 2010. Electrochemical Aspects of Electrospray and Laser Desorption/Ionization for Mass Spectrometry. In *Annual Review of Analytical Chemistry, Vol* 3, pp. 231-54. Palo Alto: Annual Reviews]

Recently, an inductive or induced electrospray ionization method has been reported by Cooks et al. [Huang G, Li G, Ducan J, Ouyang Z, Cooks R G. 2011. Synchronized Inductive Desorption Electrospray Ionization Mass Spectrometry. *Angewandte Chemie*-International Edition 50: 2503-06; Huang G, Li G, Cooks R G. 2011. Induced Nanoelectrospray Ionization for Matrix-Tolerant and High-Throughput Mass Spectrometry. Angewandte Chemie-International Edition 50: 9907-10]. A pulsed high voltage waveform is applied on an electrode 2 mm from a nanospray emitter to induce voltage inside the emitter for sample electrospray ionization. The pulsed voltage is generated by a pulsed power supply with 10-5000 Hz and 0-8 kV. In comparison with classic ESI, the high voltage is not directly applied to the sample solution during the inductive ESI, and no electrode reaction can occur. Similarly, inductive ESI by Alternating Current (AC) high voltage is reported by Zhang et al. [Peng Y, Zhang 5, Gong X, Ma X, Yang C, Zhang X. 2011. Controlling Charge States of Peptides through Inductive Electrospray Ionization Mass Spectrometry. Analytical Chemistry DOI: 10.1021/ac2024969].

Electrospray ionization is a general ionization technique that has been applied to a wide range of biomolecules and coupled to various types of mass analyzers, such as Ion Traps (IT), Time-Of-Flight (TOF), quadrupole, Fourier-Transform Ion Cyclotron Resonance (FT-ICR) and IT-orbitrap.

SUMMARY OF THE INVENTION

The present invention provides a method of spraying microdroplets from a liquid layer on an insulating plate, the liquid being present as sessile droplets on an insulating plate, or pendant droplets from an insulating plate, or as a droplet in a microwell in an insulating plate, or as a liquid contained in a porous matrix on an insulating plate. The method comprises charging locally the surface of the liquid layer with ions. To charge this interface, two electrodes are used. One is placed behind the insulating plate. The other, the counter-electrode, is placed opposite the liquid layer and separated from it by a gas or simply air. When a voltage is applied between the electrode and the counter-electrode, the system acts as two capacitors in series. The first capacitor is a metal (i.e. the electrode)-insulator-liquid solution capacitor and no net direct current (DC) can flow through it. The second capacitor is at the liquid layer and is a liquid solution-gas-metal (counter-electrode) capacitor. When the charge accumulated on the second capacitor is too large, the local surface tension at the liquid layer is not sufficient to prevent the emission of charged microdroplets, and this second capacitor can be considered as a leaky capacitor with a diode in parallel. Of course, the method being electrostatic based on the discharge of a capacitor it is not possible to maintain a constant spray.

An aspect of the present invention is an electrical circuit using a constant high voltage power supply designed to control the charging and discharging of the capacitors to obtain a pulsed spray ionization method, which can be operated in a single pulse mode or in a series of pulses with adjustable intervals and durations.

The present invention provides an electrostatic spray ionization method based on the use of a constant high voltage power supply and an electric circuit to sequentially charge and discharge a solution deposited on an insulating plate as droplets, or deposited in a microwell within an insulating plate, or deposited on a porous matrix on an insulating plate.

The invention uses a constant high voltage power supply in conjunction with two switches to reset the capacitors. Upon application of a positive high voltage to the electrode behind the insulating plate, the spray occurs, the positive charge on the electrode remains but part of the positive charge located at the liquid layer is sprayed, meaning that an excess negative charge builds up in the liquid during the spray. To alleviate this problem, the first switch placed between the electrode and the power supply is open and the second switch placed between the first electrode and the common or ground is closed to discharge the positive charge from the capacitor. The timing between opening one switch and closing the other switch is a crucial aspect of the invention. The negative charge built up in solution is then released by spray of negative charges when the second switch is closed. When the liquid layer is electroneutral, the cycle can be started again. The activation of the two switches can be computer controlled. In summary, when a positive high voltage is applied to the electrode by closing the first switch, positive ions are ejected to the counter electrode which can be a mass spectrometer. Then, by opening the first switch and keeping the second switch open, the system is open circuit and no ions are emitted. By closing the second switch, negative ions are ejected to the mass spectrometer until electroneutrality in the liquid layer is recovered. Alternatively, when a negative high voltage is applied to the electrode by closing the first switch, negative ions are ejected to the counter electrode which can be a mass spectrometer. By opening the first switch and keeping the second switch open, the system is open circuit and no ions are emitted. By closing the second switch, positive ions are ejected to the counter electrode which can be a mass spectrometer until electroneutrality in the solution is recovered.

The presence of the insulator between the electrode and the liquid layer prevents a redox reaction at the surface of electrode. This is a clear advantage over classical electrospray methods where electrochemical reactions that can destroy the samples take place. The constant high voltage power supply in the setup of the invention can be battery operated and then the setup can be used as the ion source of miniature mass spectrometers.

The present method can be applied to electrostatic spray from a droplet deposited on an insulating ceramic or polymer plate. This plate can be patterned to hold droplets by capillary forces. The plate can be machined to obtain a microwell or a microwell array to hold droplets. The plate can be partially covered by a porous matrix made of ceramic or polymer.

The present method does not overflow the mass spectrometer with excessive data as the spray can be switched on and off when required. A key feature of this invention is that a single pulse can be used to spray from a very small amount of sample, for example deposited as a droplet on an insulating plate or in a microwell or in a porous matrix.

BRIEF DESCRIPTION OF THE DRAWINGS

The principle and applications of this invention will now be described in detail by way of example only, with reference to the accompanying drawings, in which:

FIG. 20 shows the mass spectra of (a) 250 nM angiotensin I in 50% MeOH/49% $H_2O$/1% acetic acid and (b) 1600 nM cytochrome c in 50% MeOH/49% $H_2O$/1% acetic acid from a piece of lintfree paper obtained by the invention, where the paper is placed on an insulating plate and an electrode is placed under the insulating plate.

DETAILED DESCRIPTION OF SPECIFIC EMBODIMENTS

Hereinafter, the present invention is described in more detail.

Figure 1:
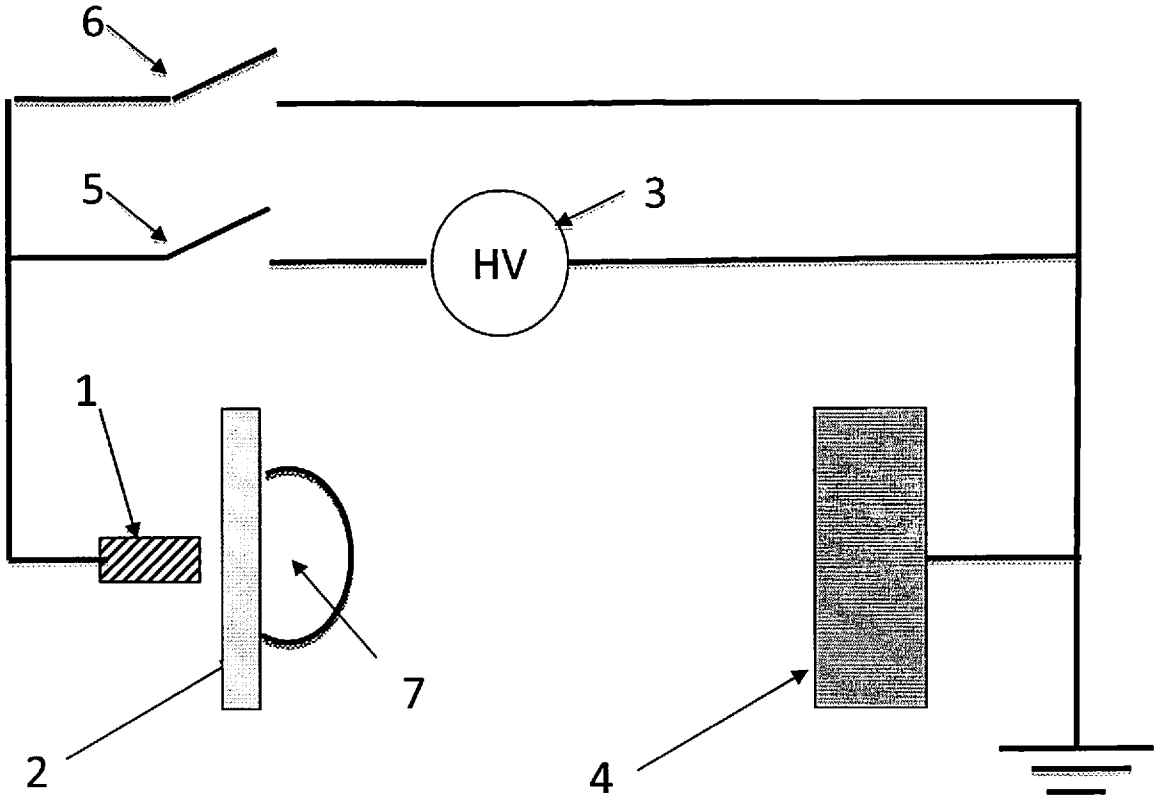
FIG. 1 shows a schematic representation of the electrical circuit allowing charging and discharging of a droplet by using a constant high voltage power supply to drive the electrostatic spray ionization.

FIG. 1 shows a setup comprising an electrode 1 placed in contact or close to an insulating plate 2 on which a liquid layer of an electrolyte solution 7 is deposited as a droplet. The electrode 1 can be a metallic electrode in contact or close to the insulating plate. A high potential difference 3 is applied between the electrode 1 and a counter electrode 4 by closing a switch 5, a second switch 6 being open. Microdroplets 8 are sprayed as a result. In mass spectrometry, the mass spectrometer replaces the counter electrode 4.

Figure 2:
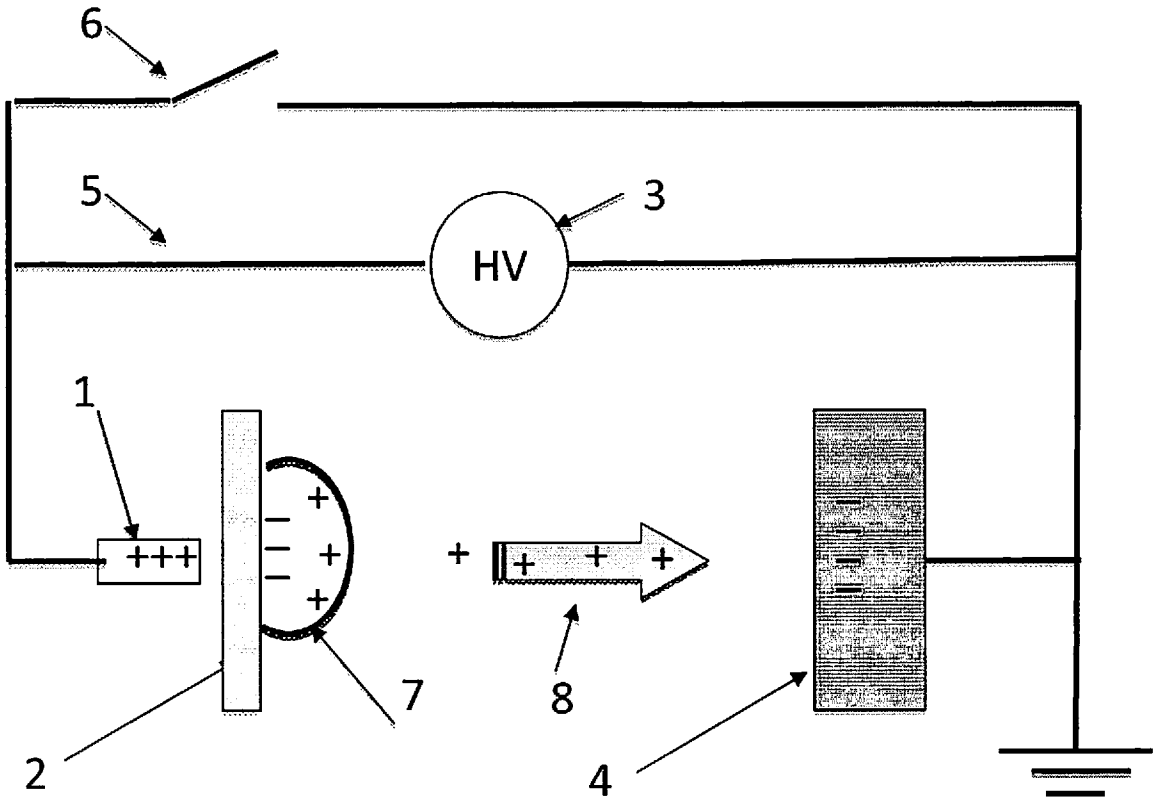
FIG. 2 shows schematically the charge accumulation during electrostatic spray for the setup of FIG. 1, when a positive high potential is applied to the electrode.
Figure 3:
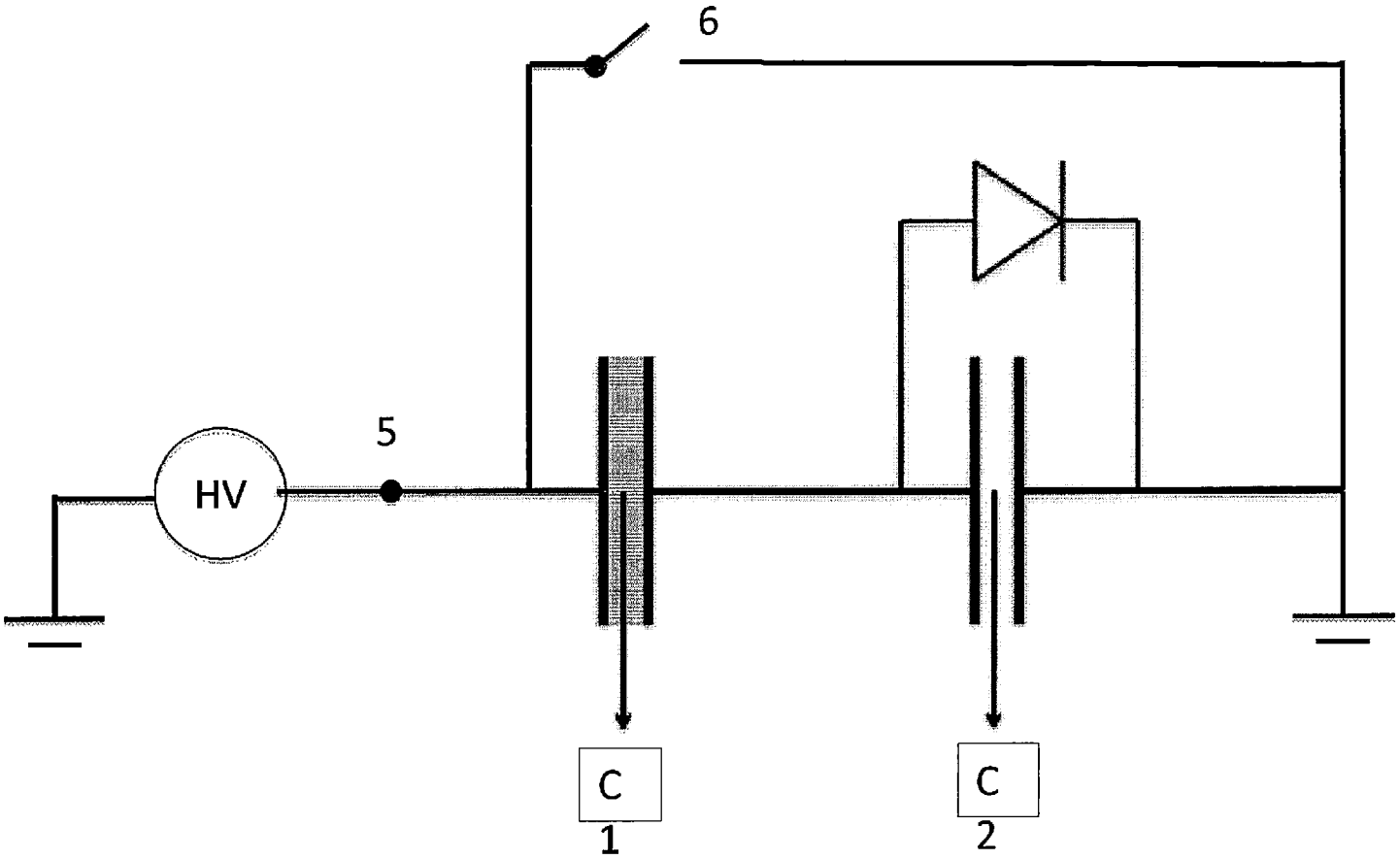
FIG. 3 shows the equivalent electrical circuit during the spray of positive charges, when a positive high voltage is applied.

As shown in FIGS. 2 and 3, when the high voltage is applied between the electrodes 1 and 4, two capacitors in series are formed. A first capacitor C1 is formed between the electrode 1 and the electrolyte solution 7 on the insulating plate and another capacitor C2 between the electrolyte solution 7 and the counter electrode 4, the air gap acting as an insulator. If the applied voltage is high enough, the surface tension of the droplet is not sufficient to hold the liquid and electrostatic spray can happen thereby discharging the second capacitor as shown in FIG. 3 using an equivalent electrical circuit, in which a diode is used to schematize the spray current discharging the second capacitor.

Figure 4:
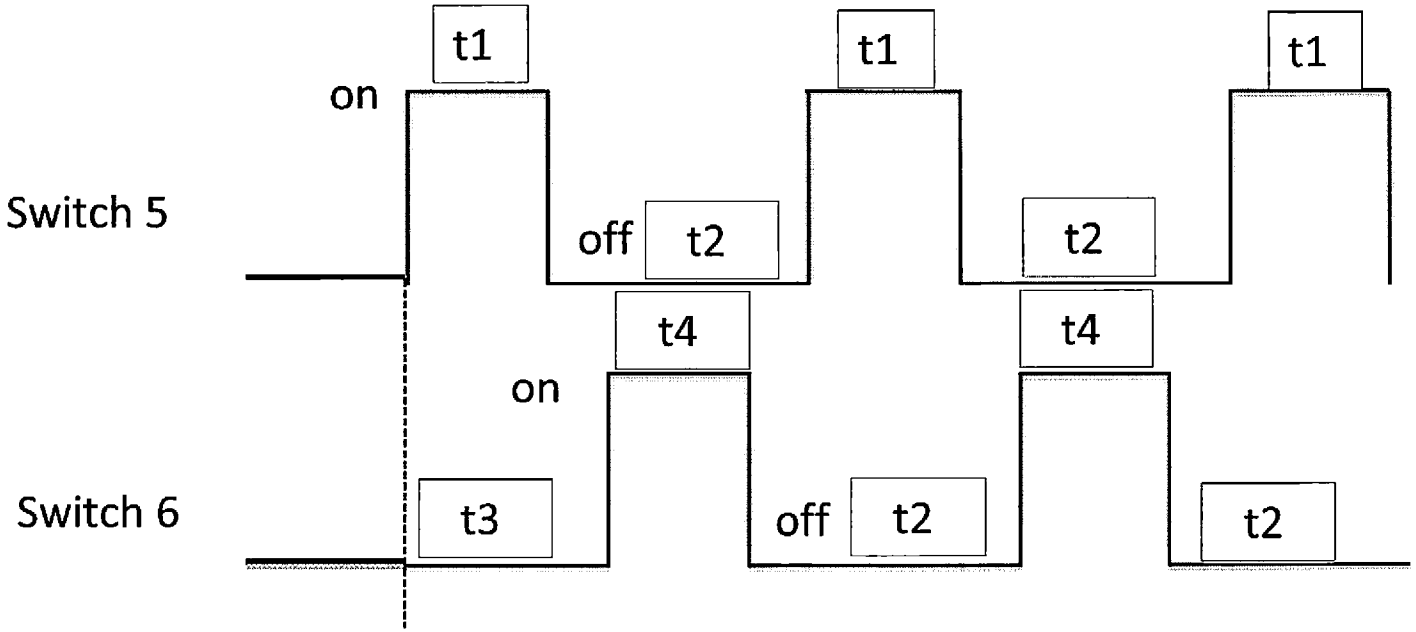
FIG. 4 shows an example of the waveform generated to control the switches.

As shown in FIG. 4, the time delays illustrated on the figure can be varied to optimize the electrospray ionization performance. The switches are controlled by defining the times t1, t2, t3, and t4 as illustrated.

Figure 5:
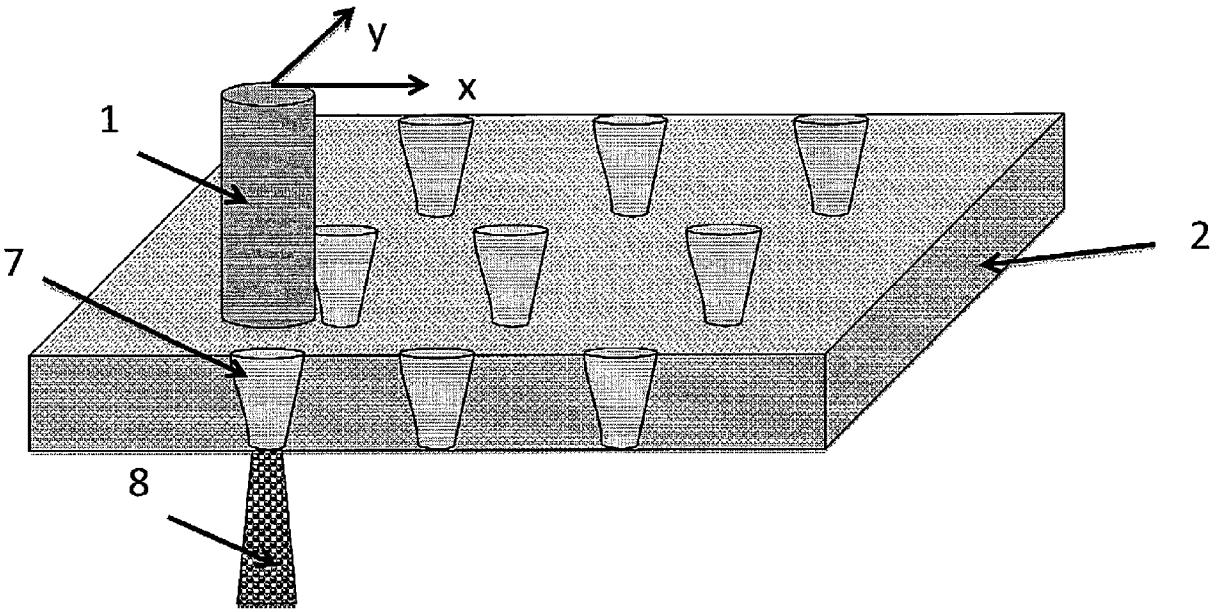
FIG. 5 shows schematically a microwell array and the high voltage electrode to instigate electrostatic spray from a given well.

When a droplet array or a microwell array is used as shown in FIG. 5, the electrode 1 or the insulating plate 2 can be mounted on an x,y stage to address each well. The power source 3 can be any constant high potential power supply including a battery operated power supply. The counter electrode 4 can be a metallic plate, but for mass spectrometry it is the mass spectrometer itself.

Figure 15:
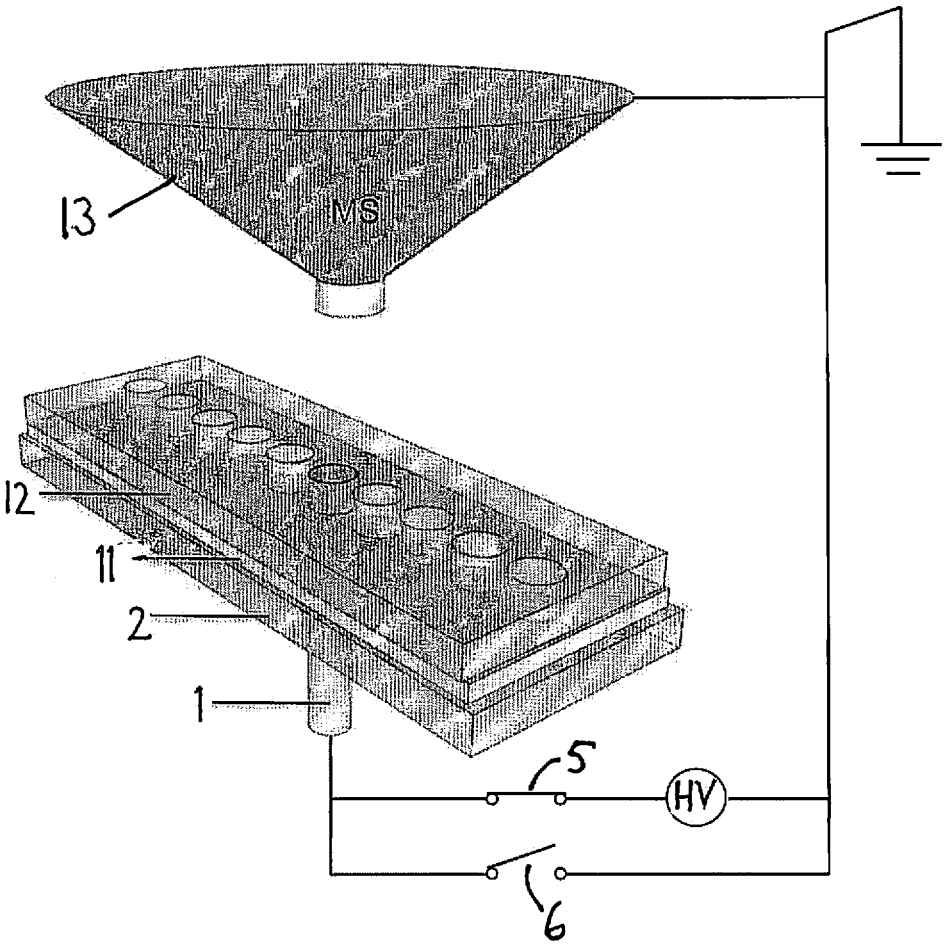
FIG. 15 shows the MS analysis of proteins in gel when a plastic cover patterned with holes is used, where the gel layer is placed on an insulating plate.

FIG. 5 shows a microwell array drilled on an insulating material such as polymer, ceramic, glass, etc. . . . The array can be drilled mechanically or produced by classical micromachining techniques such as laser photoablation, photolithography, hot embossing, etc. . . . When the electrode 1 is placed behind an individual well, the circuit shown in FIG. 1 can be used to induce the electrostatic spray from this well. Alternatively, the plate can be perforated to be filled from behind. In this case, the electrode 1 is covered by an insulating layer. The plate can also be perforated with an array of holes to form a cover 12 and then placed on top of a sample, such as a liquid layer, a slice of biological sample, a porous matrix 11 or a gel, which is on an insulating plate 2, to locate the area for electrostatic spray to increase the spatial resolution for MS 13 imaging of the sample, as shown in FIG. 15. The insulating plate 2 can be mounted an x,y stage to scan the surface of the sample by MS 13.

Figure 12:
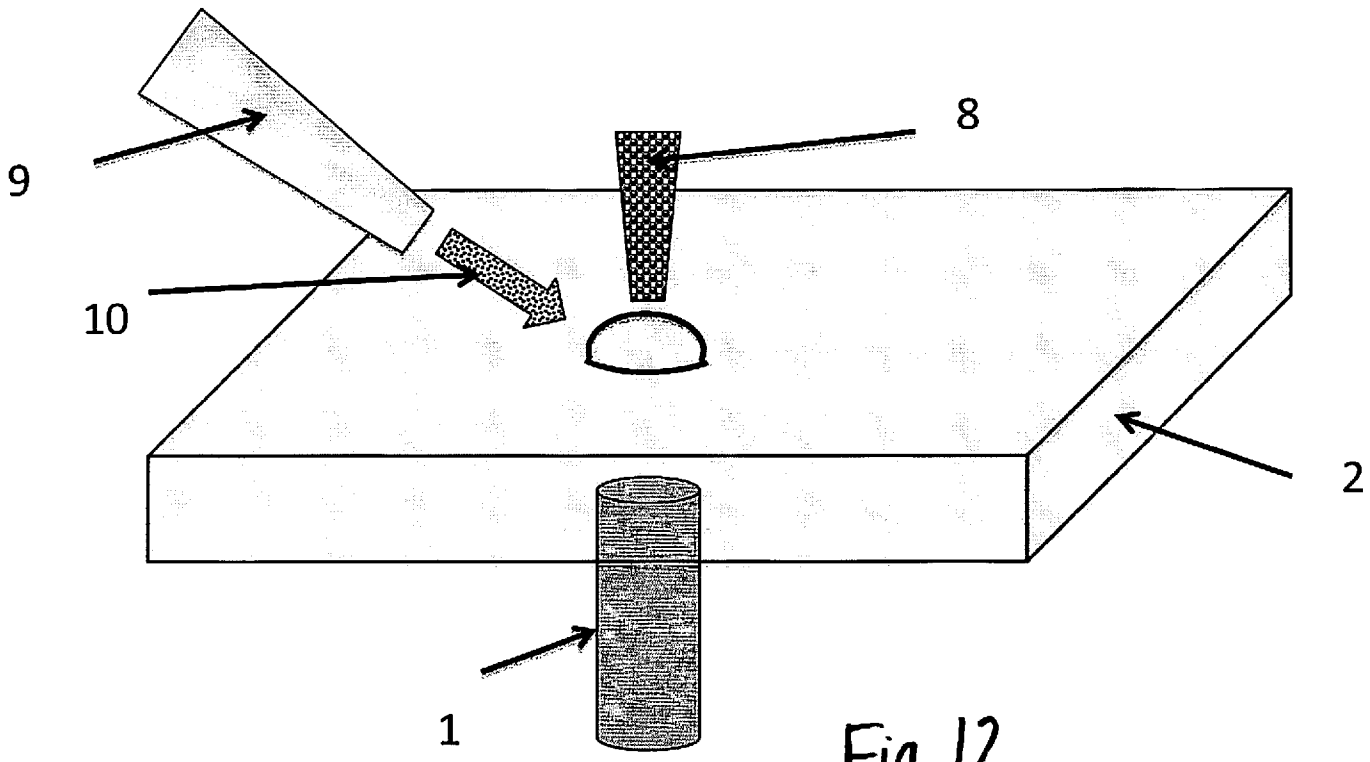
FIG. 12 shows an array of droplets dried and rewetted by a mechanical spray of solvents suitable for mass spectrometry analysis.

FIG. 12 shows a system for rewetting samples that were left to dry on the insulating plate from a solution. This is advantageous for aqueous solutions that are difficult to spray. Here, the liquid is left to evaporate and the dry sample is redissolved in a solvent mixture more suitable for mass spectrometry such as water-methanol or water-acetonitrile. The rewetting step can by done by a droplet dispenser 9 ejecting the solution 10.

Figure 13:
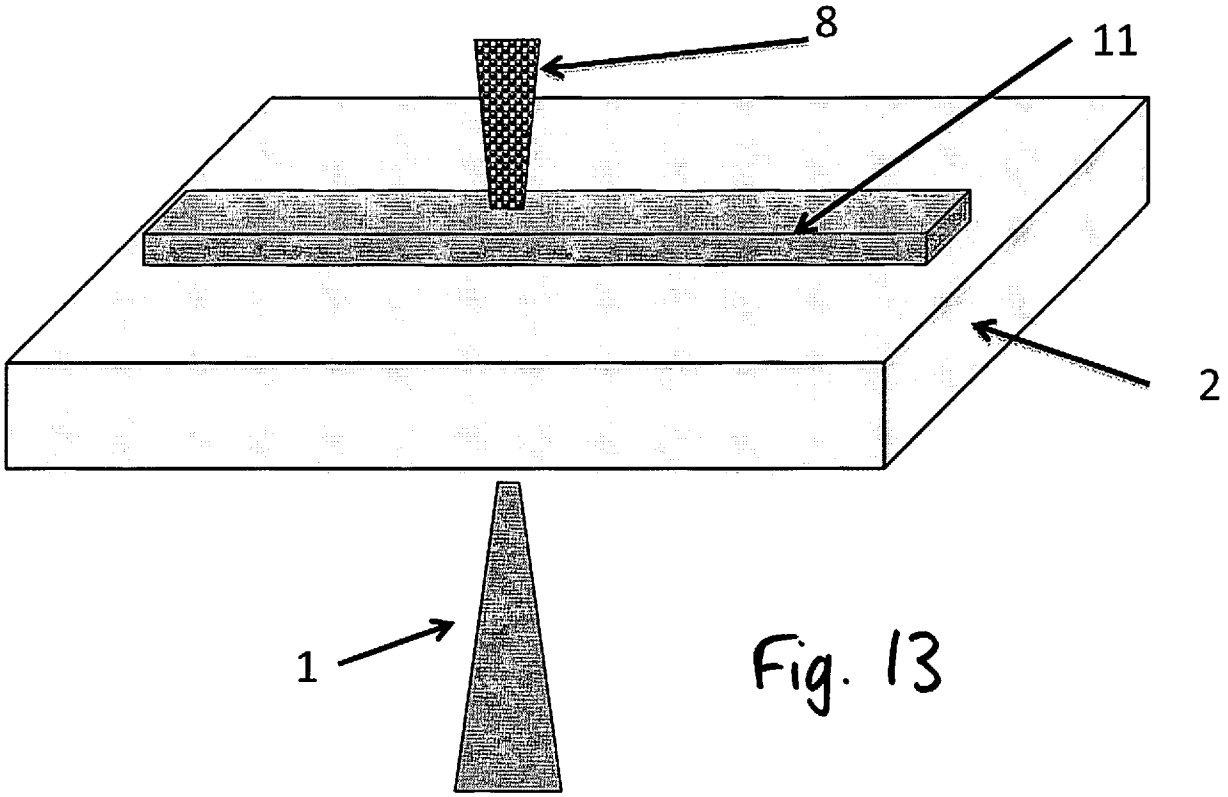
FIG. 13 shows an electrostatic spray from a solution in a gel layer on an insulating plate.

When the liquid layer is held in a porous matrix 11 as shown in FIG. 13, the electrode 1 can have a sharp tip to focus the electric field and charge locally the liquid layer. The electrode 1 or the insulating plate 2 can be mounted on an x,y stage to scan the porous matrix. In this way, it is possible to do mass spectrometry imaging of the sample held with the porous matrix. The porous matrix can be used to do an electrophoretic separation such as an isoelectric protein or peptide separation, and in this case it is possible to spray the samples directly during the electrophoretic separation or electrophoretic focusing.

Figure 17:
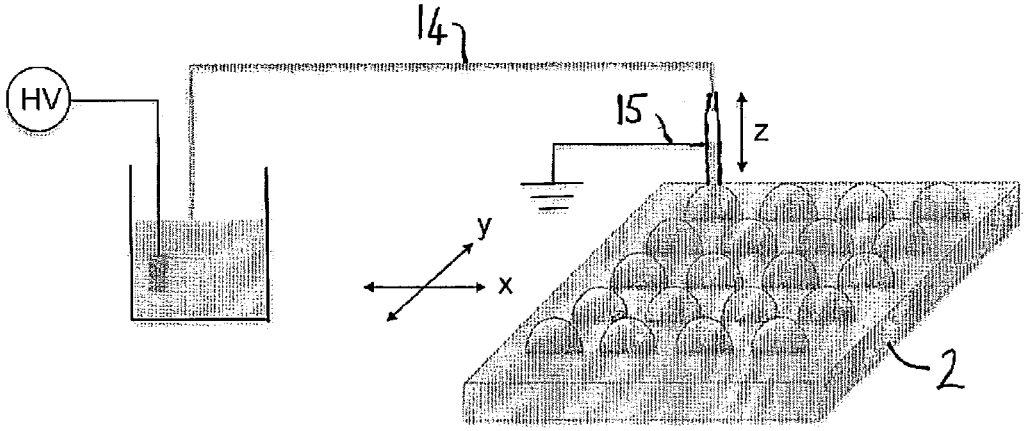
FIG. 17 shows CE separation with sample collection on a plate.

FIG. 17 shows the sample collection on an insulating plate 2. The samples were separated by capillary electrophoresis (CE). A capillary 14 is coated with silver ink at one end for performing sample collection and CE separation at the same time. The silver ink coating is connected to the ground at 15 during the CE separation.

When sample is prepared as solution and deposited on a piece of lintfree paper 16, the solution is absorbed quickly into the fibrillar structure of the paper without forming a droplet. Electrostatic spray ionization can be performed by placing this lintfree paper 16 on an insulating plate 2 before the complete evaporation of solvent. The insulating plate 2 can be mounted on an x,y stage to scan the paper by MS.

EXAMPLE 1

Electrostatic Spray Ionization of Droplets in an Array of Microwells

As shown in FIG. 5, droplets were prepared on arrays of microwells made by laser photoablation on a poly-methylmethacrylate (PMMA) substrate (1 mm thickness). The diameters of the wells range from 100 to 3000 μm and the depths range from 10 to 400 μm. The wells were covered by droplets of an angiotensin I solution (0.1 mM in 99% $H_2O$/1% Acetic acid). The PMMA substrate was mounted on a x,y stage in front of mass spectrometer inlet. A platinum electrode was placed behind the substrate such that the wells were facing the mass spectrometer inlet to induce the electrostatic spray ionization. The electrical setup was as shown in FIG. 1 (positive high voltage). By moving the substrate, samples from various droplets can be ionized for MS analysis by electrostatic spray ionization.

Figure 6:
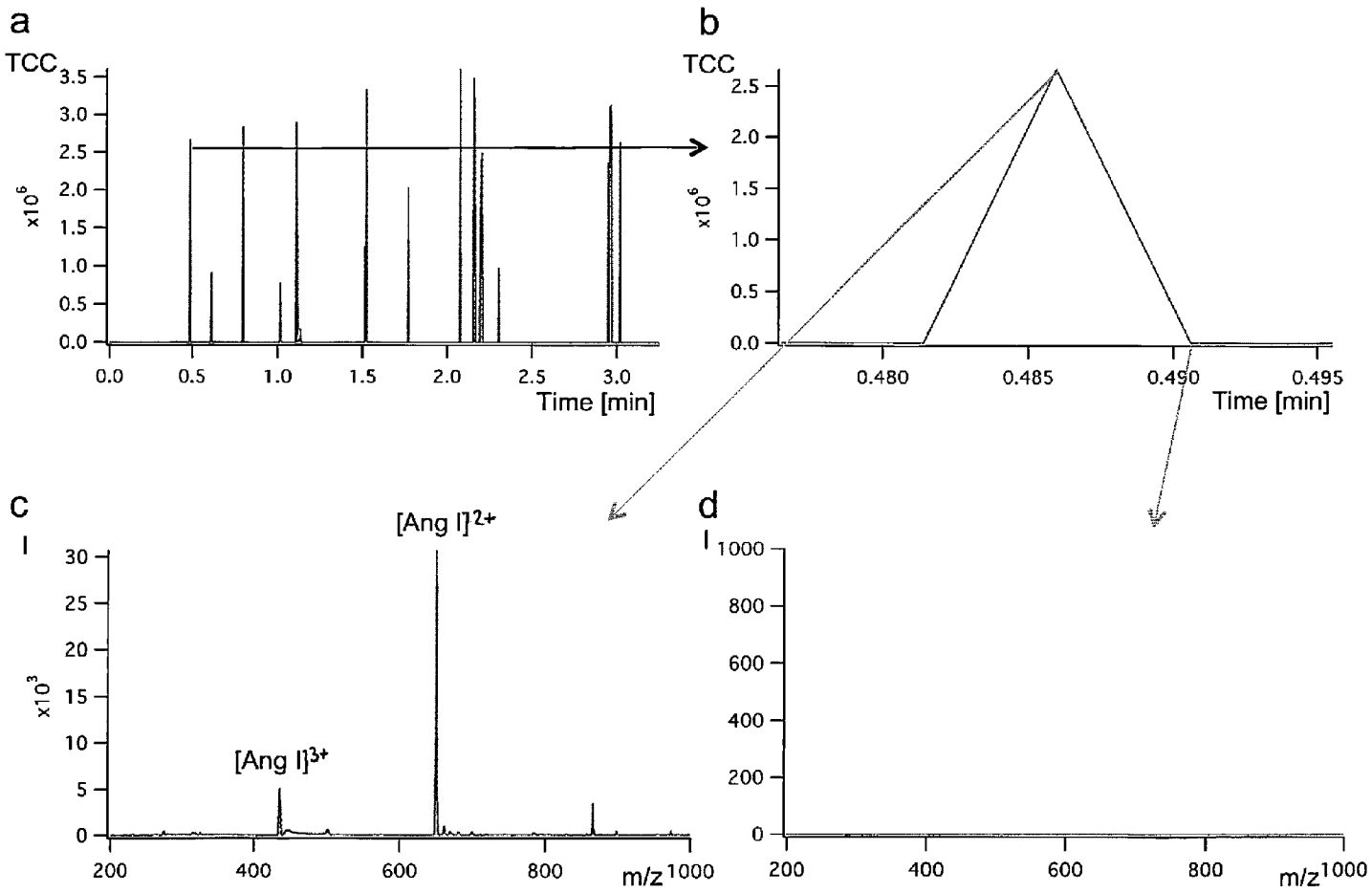
FIG. 6 shows (a, b) the total cation current (TCC) as a function of time and (c, d) the mass spectrum of angiotensin I detected by MS in the positive MS mode upon application of a positive voltage.

FIG. 6(*a, b*) shows the TCC on the MS detector as a function of time. Each peak observed on the TCC response corresponds to an electrostatic spray ionization generated from one sample droplet. Positive DC high potential was used to induce the electrostatic spray ionization. Only one spectrum of sample was generated within each peak on the TCC signal, shown as FIG. 6(*c*) and (*d*). Double and triple protonated angiotensin I ions were observed on the mass spectrum.

Figure 7:
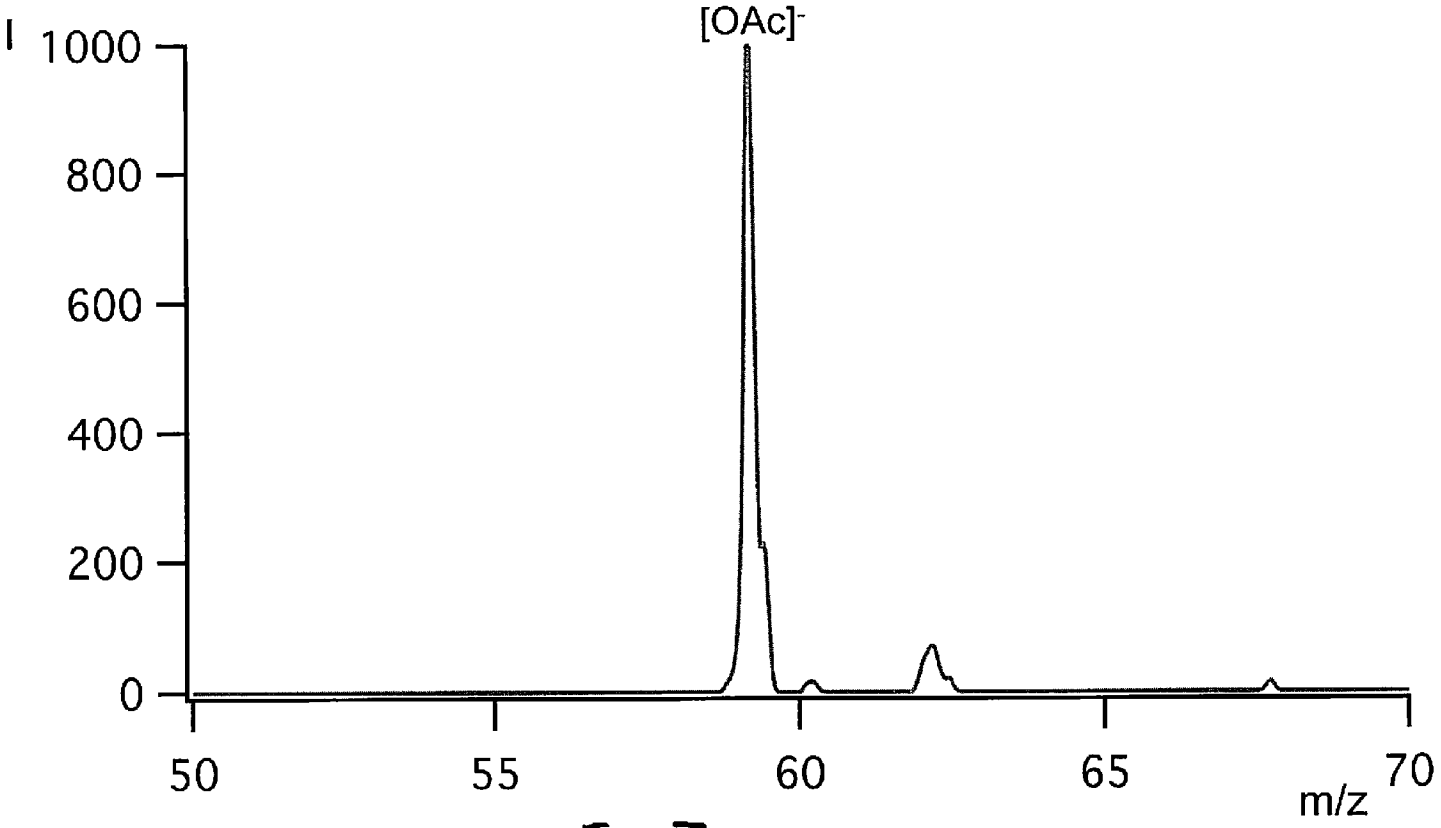
FIG. 7 shows the mass spectrum of acetate ion placed in a droplet detected by MS in the negative MS mode upon application of a negative voltage.

Keeping the application of positive DC high potential, while alternating the MS to negative detection mode, acetate ions generated during the electrostatic spray ionization were detected by the MS, as shown in FIG. 7. This phenomenon illustrates the principle that positive and negative sprays happen during an electrostatic spray ionization.

Figure 8:
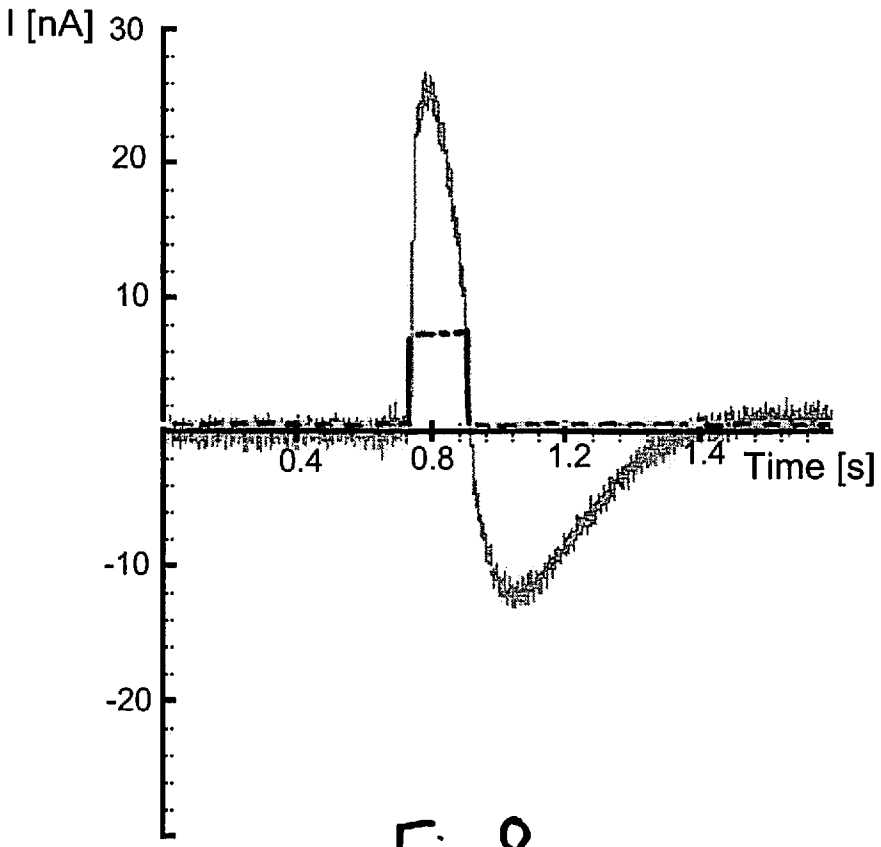
FIG. 8 shows the current measured between counter electrode and earth during single pulse electrostatic spray ionization.
Figure 9:
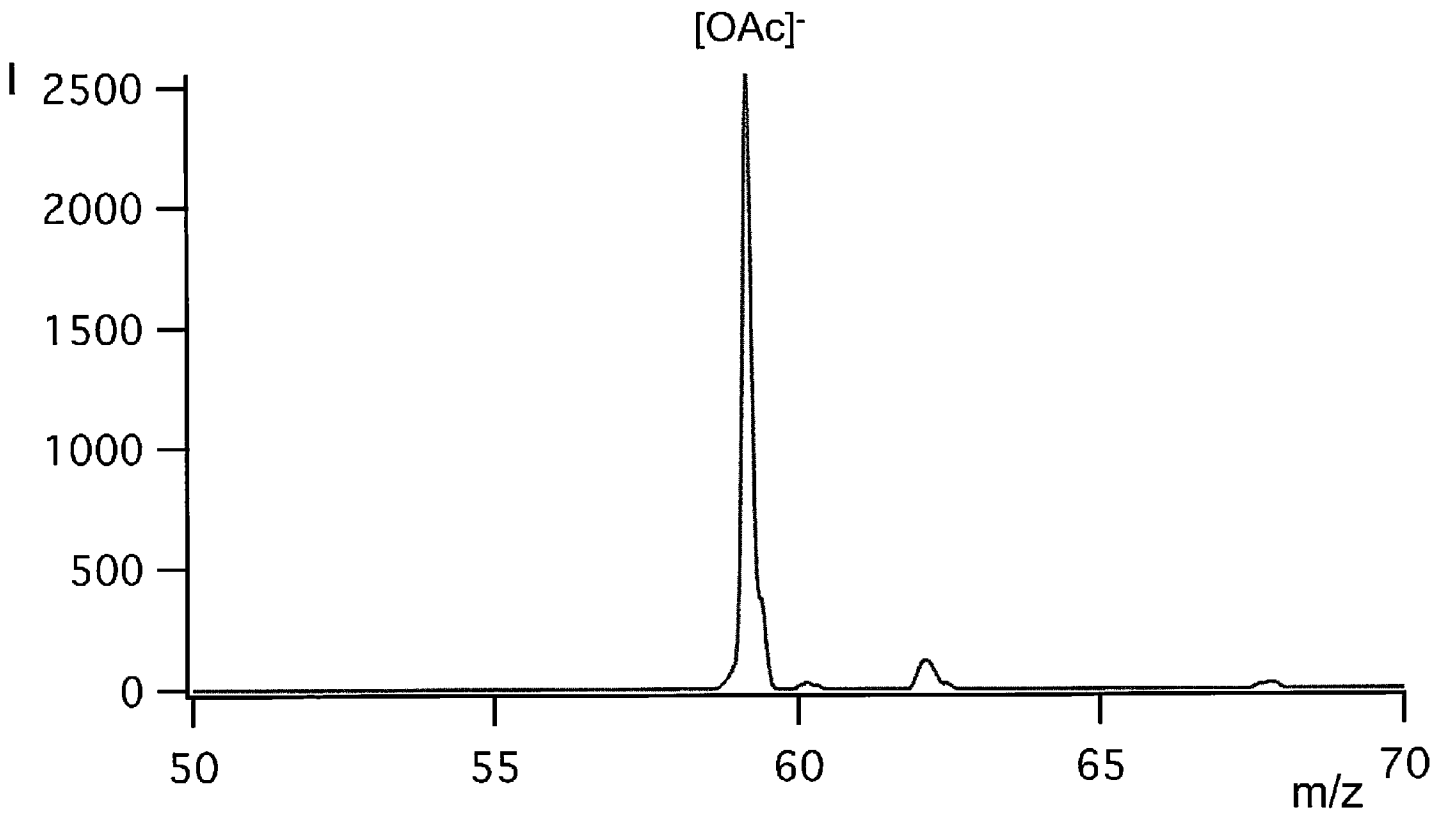
FIG. 9 shows the mass spectrum of acetate ion placed in a droplet detected by MS in the negative MS mode upon application of a positive voltage.
Figure 10:
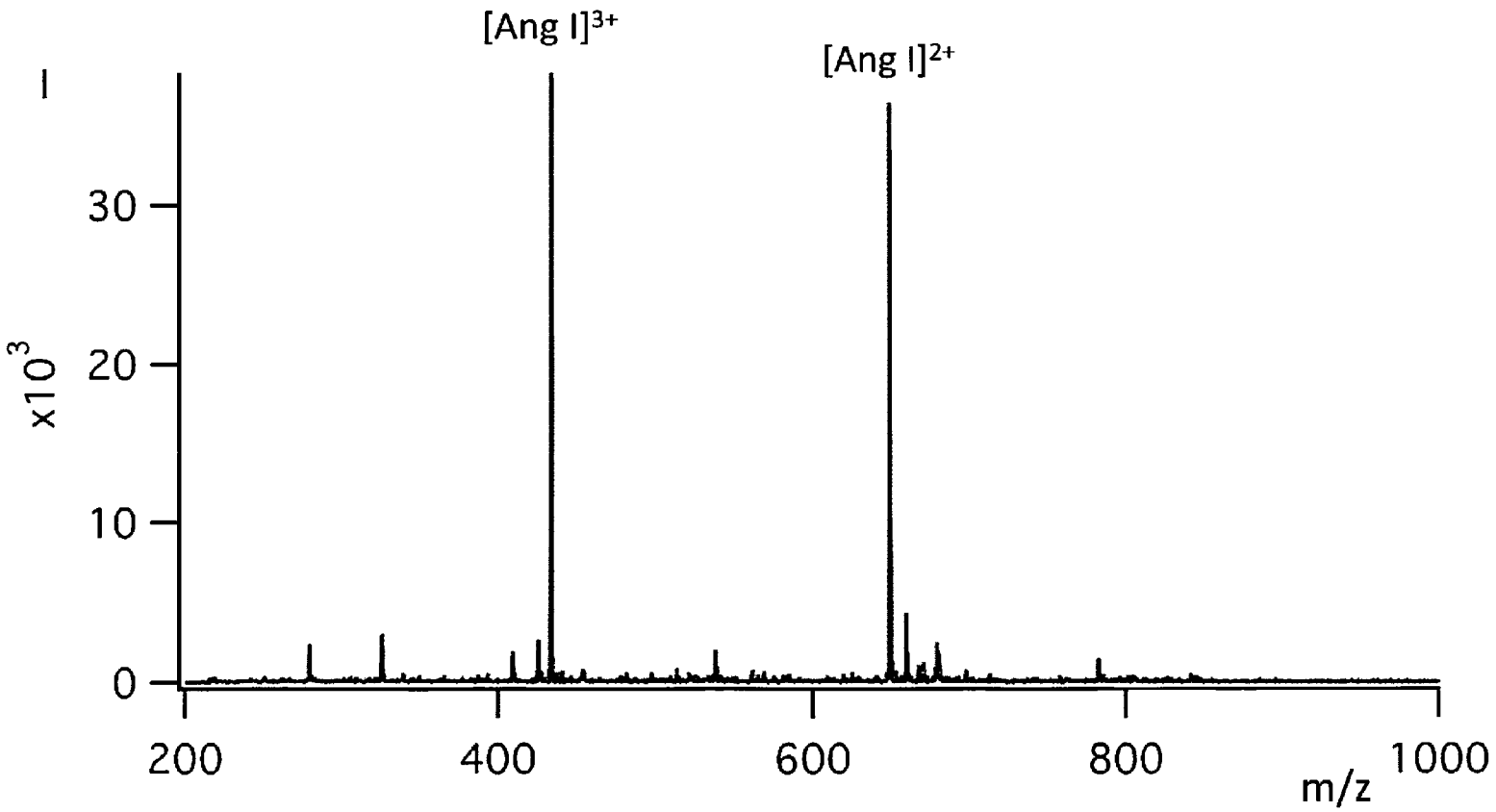
FIG. 10 shows the mass spectrum of angiotensin I placed in a droplet detected by MS in the positive MS mode upon application of a negative voltage.

When a metallic plate was used as counter electrode instead of the mass spectrometer, current generated from the electrostatic spray ionization is measured between the counter electrode and earth. As shown in FIG. 8, when the positive DC high voltage is applied to the electrode 1, positive spray current is observed. The dashed line illustrates the voltage application. A solution of 99% $H_2O$/1% Acetic acid was used for the electrostatic spray ionization. A positive high potential of 6 kV was employed to induce the electrostatic spray. While negative spray current is detected as soon as the platinum electrode is grounded and cut off from the power supply. By integrating the positive and negative currents, it was found that positive and negative sprays give the same amount of charges. The measured electrostatic spray currents also demonstrate the proposed capacitor charging-discharging principle for the electrostatic spray ionization. By changing the polarity of the power supply, anions should be sprayed during the capacitor charging process and cations should be sprayed during the capacitor discharging process. As shown in FIGS. 9 and 10, acetate anions and angiotensin I cations were still detected by MS under negative and positive mode, respectively, when a negative high potential was used to induce the electrostatic spray ionization.

Protein solutions were deposited on the insulating substrate to be ionized by electrostatic spray ionization and detected by MS. 3 μl myoglobin solution (50 μM in 99%

Figure 11:
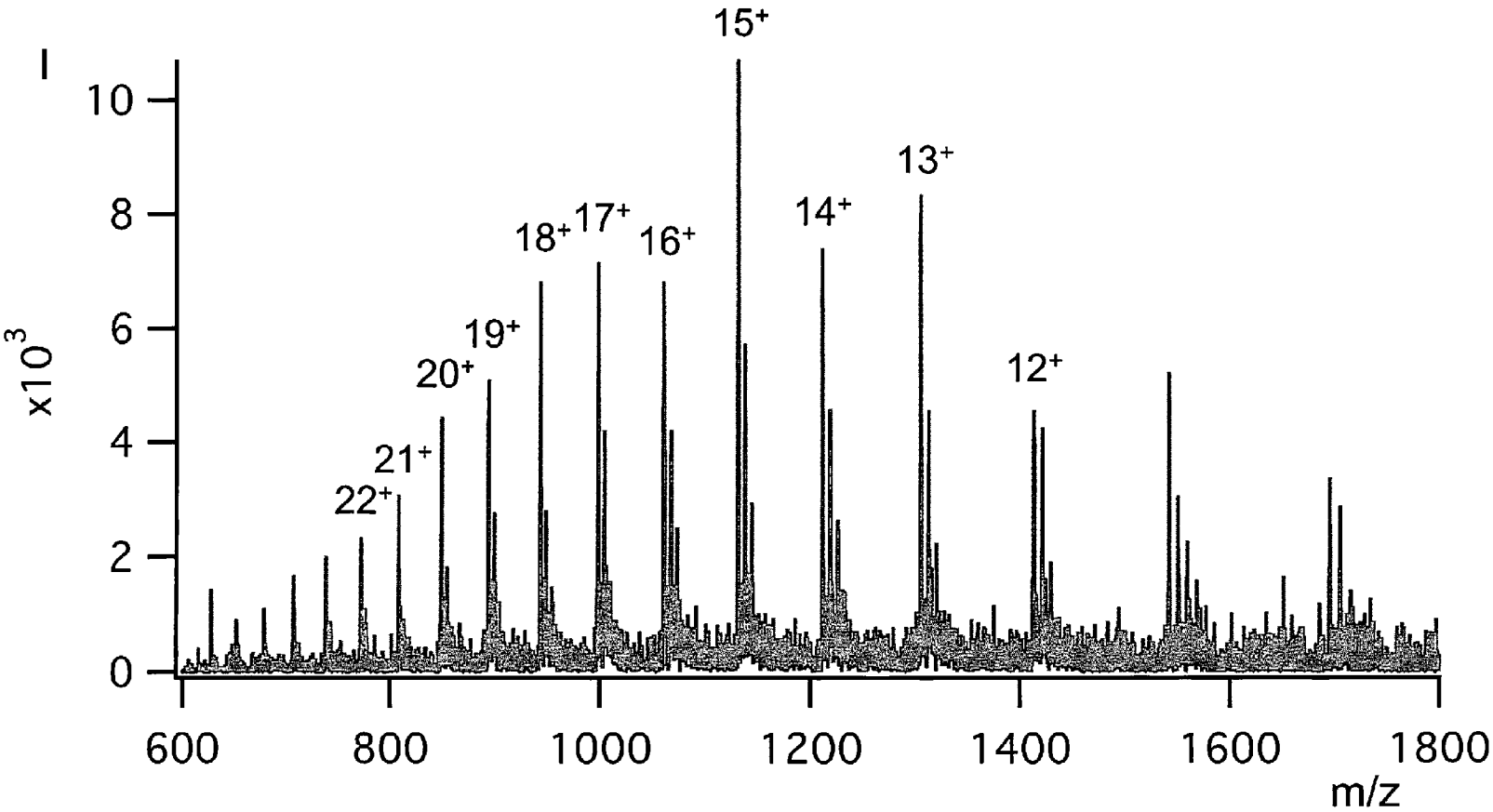
FIG. 11 shows the mass spectrum of myoglobin placed in a droplet detected by MS in the positive MS mode upon application of a positive voltage.

$H_2O$/1% Acetic acid) was deposited in a microwell of the insulating plate. An electrical setup as shown in FIG. 1 was used to trigger the electrostatic spray ionization. The obtained mass spectrum of myoglobin generated from a single spray is shown in FIG. 11. This result illustrates that the electrostatic spray ionization is capable to induce protein ionization deposited on an insulating plate to be detected by a mass spectrometer. The spectra in FIGS. 6, 7, 9, 10 and 11 are of ions generated by electrostatic spray ionization directly from a microwell array as illustrated in FIG. 5 with the electrical setup shown in FIG. 1.

EXAMPLE 2

Electrostatic Spray Ionization of the Liquid Phase from a Wet Polymer Gel

A wet polyacrylamide gel (0.5 mm thickness) was immersed in an angiotensin I solution (0.07 mM in 99% $H_2O$/1% Acetic acid). After 1 hour the gel was set on a poly-methylmethacrylate (PMMA) substrate (1 mm thickness). The PMMA substrate was mounted on a x,y stage in front of mass spectrometer inlet. A platinum electrode was placed behind the PMMA substrate such that the humidified gel was facing the mass spectrometer inlet to induce the electrostatic spray ionization. The electrical setup was as shown in FIG. 1 (positive high voltage). By moving the substrate, samples from various regions of the gel can be submitted to MS analysis by electrostatic spray ionization.

Figure 14:
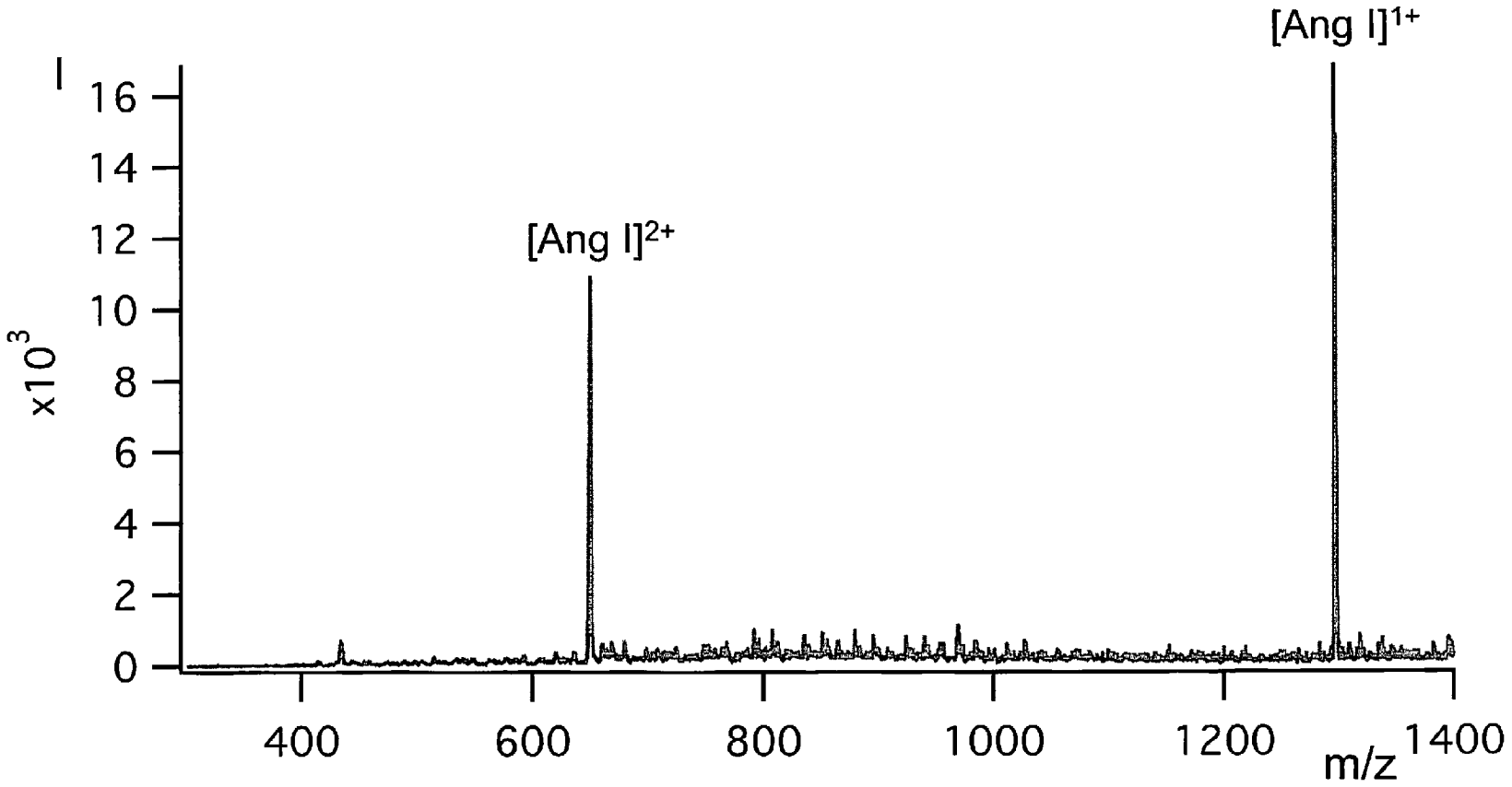
FIG. 14 shows the mass spectrum of angiotensin I placed in a porous matrix detected by MS in the positive MS mode upon application of a positive voltage.

Positive DC high potential was used to induce the electrostatic spray ionization. FIG. 14 shows ions generated from the polyacrylamide gel as shown in FIG. 13 with the electrical circuit shown in FIG. 1. Single and double protonated angiotensin I ions were observed in the mass spectrum.

EXAMPLE 3

Electrostatic-Spray Ionization of Samples Separated in a Polymer Gel by Isoelectric Focusing BSA digest was prepared with standard protocol and separated by isoelectric focusing using a polyacrylamide gel strip (pH 4 to 7) as the porous matrix 11, shown in FIG. 15. After rehydrating in water for 1 h the strip was placed in a tray of an Agilent Fractionator 3100 and a multi-well frame was placed on top of the gel to make the sample loading easier. 5 μl of BSA digest (56 μM) was loaded on the gel. Isoelectric focusing was performed under the following conditions: maximum current=150 μA, voltage applied up to 4000 V until 10 kVh was reached in 4 h.

The gel strip containing peptides was placed on thin pieces of plastic (GelBond PAG film, 0.2 mm thickness) as the insulating plate 2. A droplet of acidic buffer (1 μl, 50% methanol, 49% water and 1% acetic acid) was deposited on the gel. An electrode 1 was placed behind the plastic and facing the droplet to induce the electrostatic spray ionization. The electrode was connected with a DC high voltage (6.5 kV) source via switch 5 and grounded via switch 6. The program in FIG. 4 was used to control the switches in order to synchronize their work.

A plastic cover 12 drilled with holes (1 mm in diameter) can be placed on top of the gel as shown in FIG. 15 to help to locate the areas for electrostatic spray ionization according to the invention during surface scanning. Such a cover can also lead to a better spatial resolution of MS scanning of the gel.

A Thermo LTQ Velos linear ion trap mass spectrometer 13 was used to detect the ions produced by electrostatic spray ionization, where the MS is always grounded. The spray voltage of the internal power source of the MS was set as 0. An enhanced ion trap scanning rate (10,000 amu/s) was used for the MS analysis. For the analysis of BSA digest, the mass-to-charge ratios of peaks were read out to compare with the molecular weights of all the possible peptides generated from BSA by trypsin digestion. The on-line tools FindPept and FindMod from ExPASy (www.expasy.org) were used to help the comparison.

Figure 16:
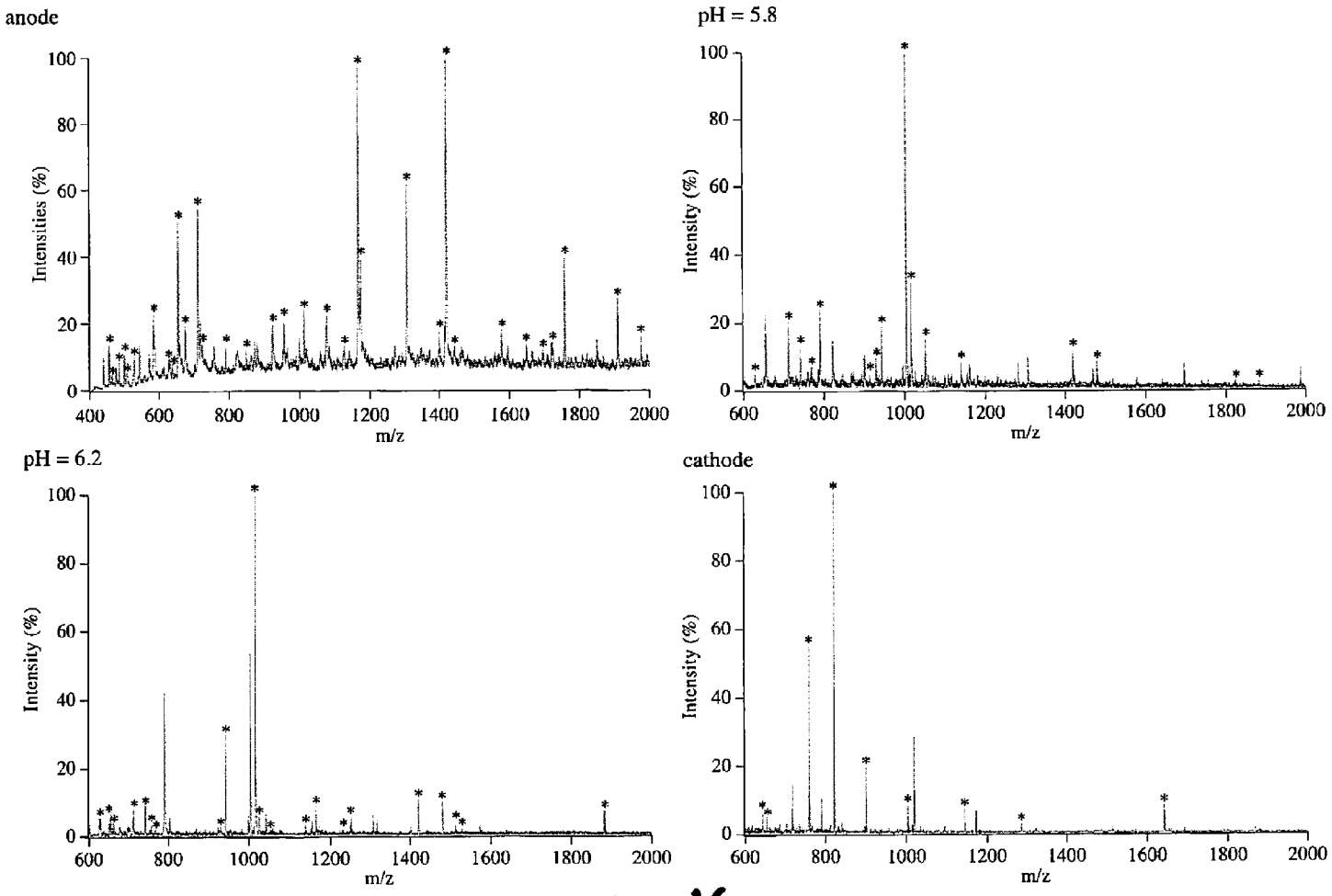
FIG. 16 shows the mass spectra of BSA tryptic digest separated by isoelectric focusing (IEF) on an immobilized pH gradient (IPG) gel strip under positive MS mode.

Electrostatic spray ionization was performed on different regions of the gel to analyse the separated peptides. The identification results from four droplets added onto the gel are shown in FIG. 16, including an area close to the anode (pH=4), an area with pH around 5.8, an area with pH around 6.2 and an area close to the cathode (pH=7). 28, 13, 19 and 13 peptides were identified from the four areas, respectively, with a good pI matching. Combining the results obtained from these 4 spots, the identification sequence coverage of BSA digest was found as 74%

FIG. 16 shows the mass spectra of BSA tryptic digest (5 μl, 56 μM) separated by IEF using an IPG strip under positive MS mode. The ions were generated by electrostatic spray ionization from different areas of the gel. A pulsed positive high potential (6.5 kV) was applied to the electrode, and 1 μl of the acidic buffer (50% methanol, 49% water and 1% acetic acid) was deposited on the gel. The peaks may correspond to single, double or triple charged ions. The asterisks identify peaks as BSA peptides.

EXAMPLE 4

Electrostatic-Spray Ionization of Samples Separated by Capillary Electrophoresis and Deposited on a Plastic Substrate A mixture of peptides generated from the tryptic digestion of myoglobin was used as a sample for capillary electrophoresis (CE) separation coupled with the electrostatic spray ionization of the invention. Standard CE separation of the myoglobin tryptic digest (150 μM, 21 nL per sample injection) followed by UV detection was firstly performed on an Agilent 7100 CE system (Agilent, Waldbronn, Germany). An untreated fused silica capillary 14 (50 μm inner diameter, 375 μm outside diameter, 51.5 cm effective length, 60 cm total length) obtained from BGB analytik AG (Bockten, Switzerland) and shown in FIG. 17 was used for separation. A solution of 10% acetic acid, pH=2, was employed as a background electrolyte. The sample was injected for 20 s at a pressure of 42 mbar. The separation was performed at a constant voltage of 30 kV.

Afterwards, the capillary was cut at the point of the detection window, and then coated with a conductive silver ink (Ercon, Wareham, Mass., USA) over a length of 10 cm from the outlet that was then fixed outside the CE apparatus. The same CE separation was performed with the same sample, while the fractions were directly collected on an insulating polymer plate 2 by a homemade robotic system. The silver ink coating was connected to the ground at 15 during the CE separation.

After drying all the droplets, the polymer plate 2 was placed between the electrode and the MS inlet. 1 μL of an acidic buffer (1% acetic acid in 49% water and 50% methanol (MeOH)) was deposited on each sample spot to dissolve the peptides for MS detection.

Figure 18:
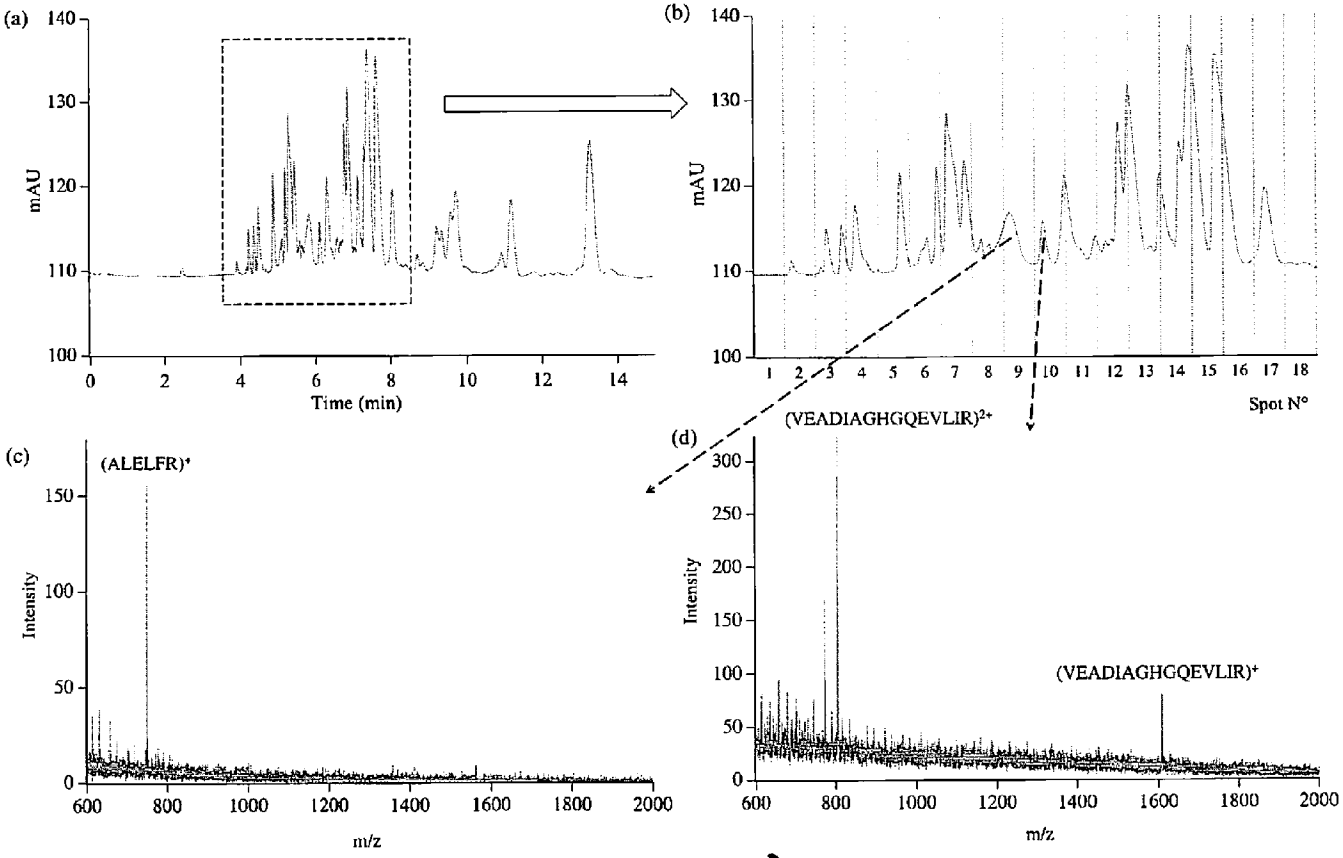
FIG. 18 shows (a, b) CE-UV of the myoglobin tryptic digestion, (c) electrostatic spray ionization-MS of fraction 9 and (d) electrostatic spray ionization-MS of fraction 10.

FIG. 18 shows the CE-UV result of the separated peptides. The peptides with a migration time between 3.5 and 8.5 min were collected on the polymer plate 2 as 18 spots shown as FIG. 18(*b*). FIG. 18(*c*) and (*d*) show the mass spectra of fractions 9 and 10, where one peptide was clearly found from each spectrum. Combining all the 18 fractions, 15 peptides were identified by the electrostatic spray ionization-MS of the invention.

EXAMPLE 5

Electrostatic Spray Ionization of Samples from Paper

Figure 19:
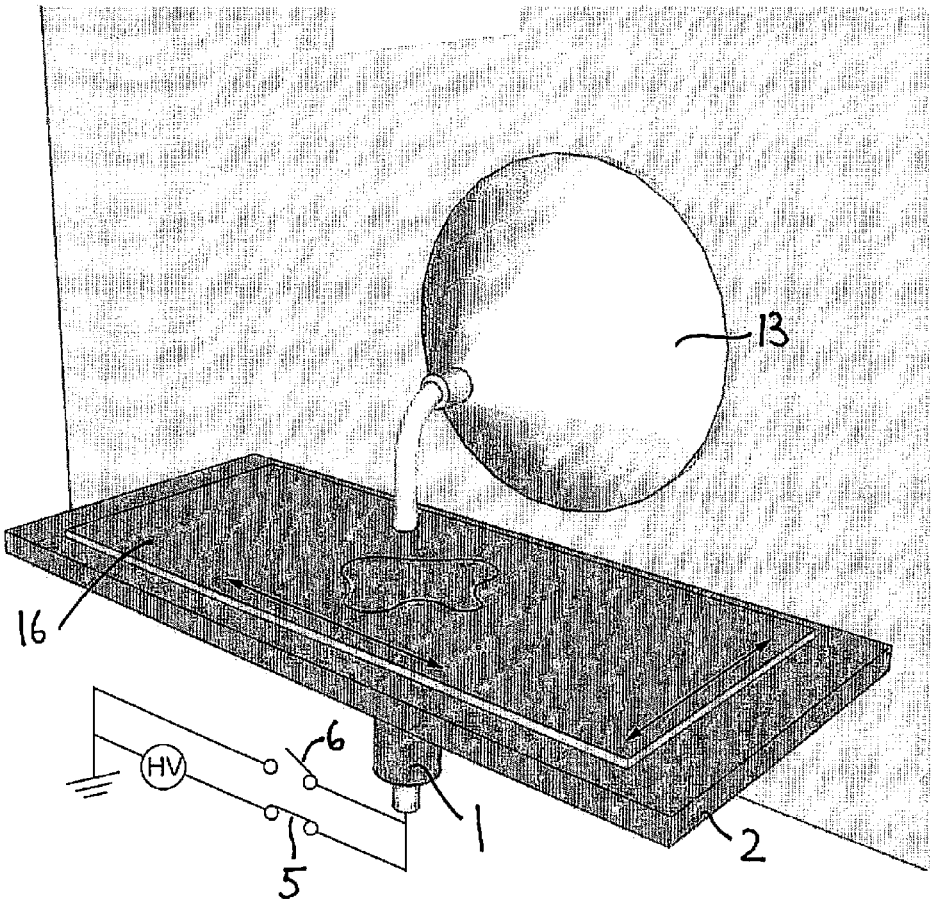
FIG. 19 shows the electrostatic spray ionization-MS detection of samples on a piece of paper placed on an insulating layer, where an electrode is placed under the insulating layer.
Figure 2B:
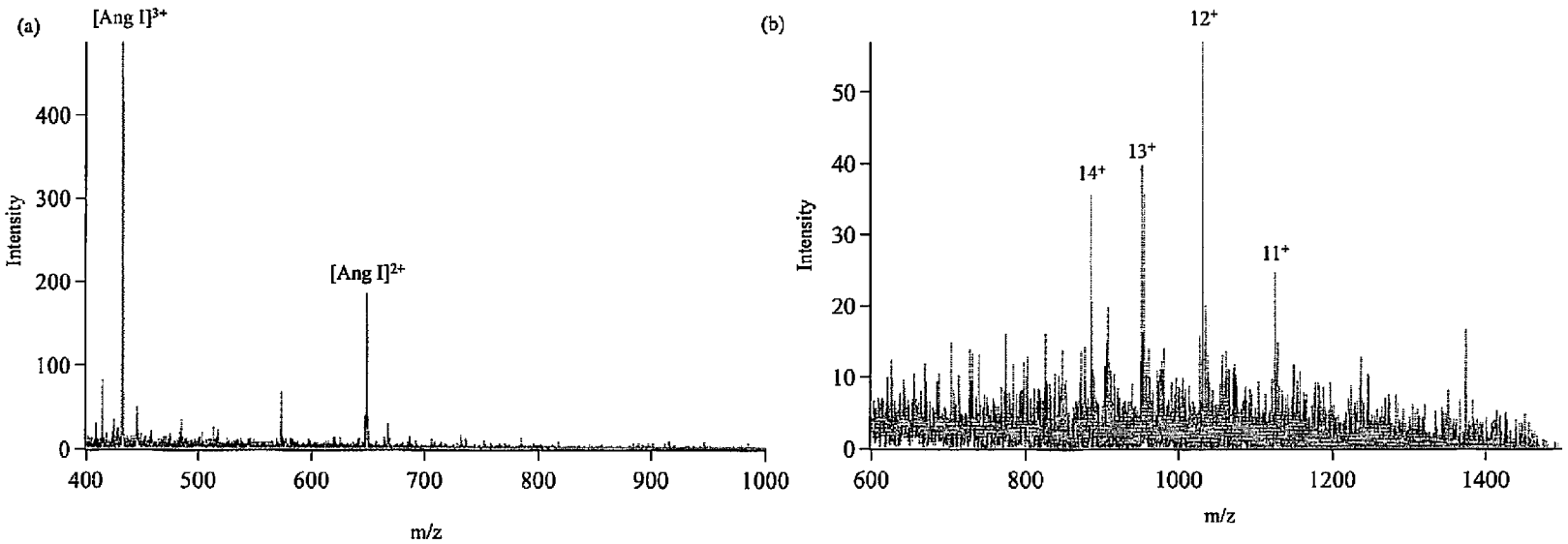

Proteins and peptides were deposited on a piece of lintfree paper 16 shown in FIG. 19. The droplets were absorbed quickly into the fibrillar structure of the paper. The paper was placed on an insulating plate 2 between the electrode 1 and the MS 13. By applying high voltage to the electrode, samples were ionized for MS detection before the solvent was completely evaporated from the paper 16. During the electrostatic spray ionization, no droplet was formed on the surface of paper.

Detection of cytochrome c and angiotensin I was realized with a limit of detection of 1.6 μM and 250 nM, respectively, by a linear ion trap mass spectrometer, as shown in FIG. 20. The samples were prepared in a buffer containing 50% methanol, 49% water and 1% acetic acid.

Figure 21:
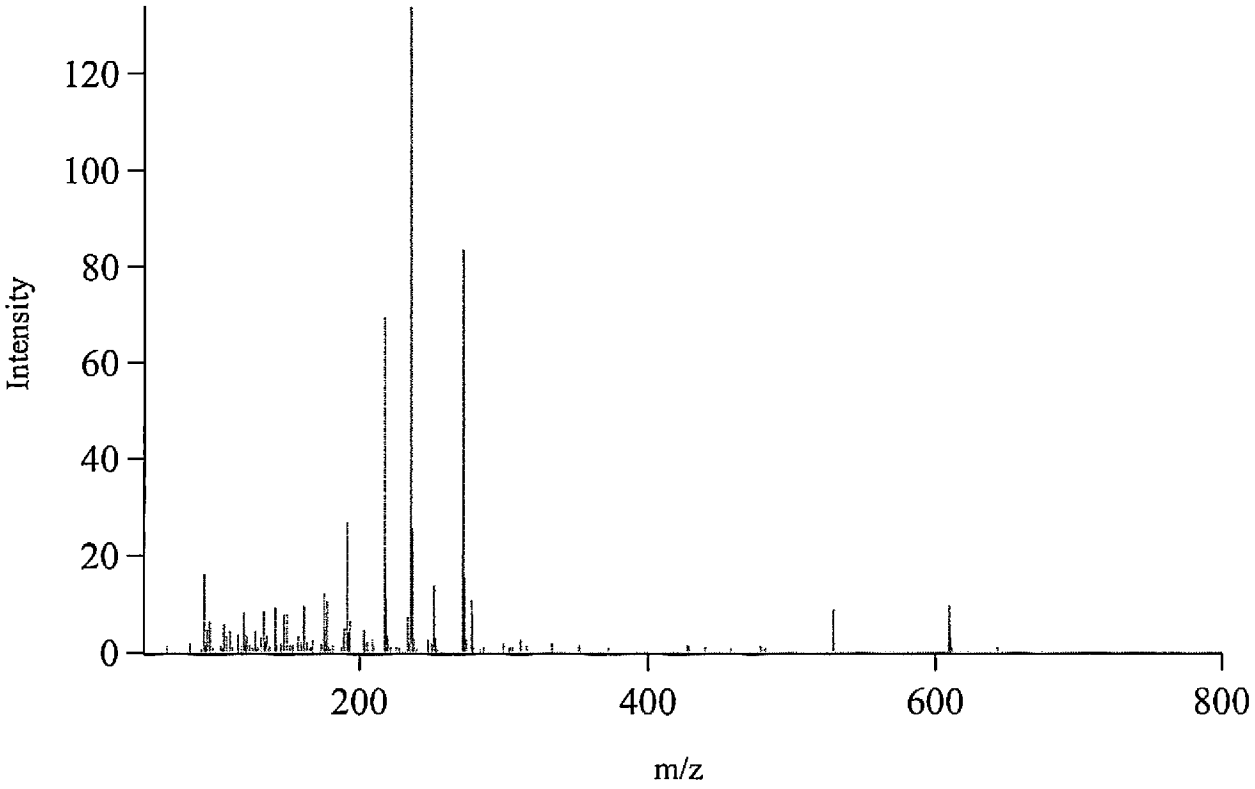
FIG. 21 shows the mass spectra of perfume sprayed on a piece of lintfree paper obtained by electrostatic spray ionization-MS, where the paper is placed on an insulating plate and an electrode is placed under the insulating plate.

By spraying Givenchy Lady's perfume on the lintfree paper, detection of perfume components was realized by the electrostatic spray ionization-MS of the invention as shown in FIG. 21.

The invention claimed is:

1. An electrostatic spray ionization method for spraying a liquid layer from an insulating plate, the method comprising arranging the plate between two electrodes, one of the electrodes being placed behind the insulating plate, and the other electrode—the counter-electrode—being placed opposite the liquid layer and separated from it by a gas or air, providing a constant high voltage power supply and using an electric circuit to charge locally a surface of the liquid layer on the insulating plate by applying said power supply between the electrodes and to discharge the surface.

2. An electrostatic spray ionization method according to claim 1 wherein the insulating plate is partially covered by the liquid layer to be sprayed, and wherein the other electrode is a counter-electrode provided by a mass spectrometer.

3. An electrostatic spray ionization method according to claim 1 wherein the insulating plate has been patterned to hold the liquid layer as droplets or an array of droplets.

4. An electrostatic spray ionization method according to claim 1 wherein a microwell or an array of microwells have been micromachined in the insulating plate to hold droplets or an array of droplets.

5. An electrostatic spray ionization method according to claim 1 wherein the insulating plate has been microperforated to hold droplets or an array of droplets and the electrode is covered by an insulating layer.

6. An electrostatic spray ionization method according to claim 1 wherein the insulating plate has been partially covered by a porous matrix able to hold the liquid layer.

7. An electrostatic spray ionization method according to claim 1, wherein said one electrode is connected through two switches alternately to the constant high voltage power supply to charge the liquid layer on or in the insulating plate thereby onsetting electrostatic spray; and to a common potential, e.g. ground, thereby discharging the interface.

8. An electrostatic spray ionization method according to claim 7 wherein the two switches are synchronized.

9. An electrostatic spray ionization method according to claim 1, wherein positive ions are detected by mass spectrometry when a positive potential is applied to said one electrode and wherein negative ions are detected after switching off the potential and connecting said one electrode to the common potential.

10. An electrostatic spray ionization method according to claim 1, wherein negative ions are detected by mass spectrometry when a negative potential is applied to said one electrode and wherein positive ions are detected after switching off the potential and connecting said one electrode to the common potential.

11. An electrostatic spray ionization method according to claim 1, wherein an array of droplets is held on the insulating plate and the insulating plate or the high voltage electrode is mounted on an x-y positioning system to spray sequentially a droplet from the array.

12. An electrostatic spray ionization method according to claim 1, wherein an array of droplets is allowed to dry on the insulating plate and is rewetted either by mechanical spray or a droplet dispenser with solvent mixtures appropriate for electrospray mass spectrometry.

13. An electrostatic spray ionization method according to claim 1, wherein the liquid layer comprises a porous matrix, such as a gel layer, an array of a gel layer, or a strip of gel layer containing the analytes to be sprayed.

14. An electrostatic spray ionization method according to claim 13, wherein the gel is a polyacrylamide gel, either native or containing immobilines, or the gel is made of agarose, where the gel has been used or is being used for electrophoretic separation.

15. An electrostatic spray ionization method according to claim 1, wherein a microhole or an array of microholes has been patterned in an insulating foil and placed on top of the liquid layer, which may be a slice of biological sample, a porous matrix or a gel placed on the insulating plate to define areas from which to initiate the electrostatic spray to increase spatial resolution.

16. An electrostatic spray ionization method according to claim 1, wherein the insulating plate is mounted on an x-y positioning system for performing the mass spectrometry imaging of molecules present on the insulating plate in the liquid layer, which may be a slice of biological sample, a porous matrix or a gel.

* * * * *